US009314073B2

(12) United States Patent
Kaltenrieder et al.

(10) Patent No.: US 9,314,073 B2
(45) Date of Patent: Apr. 19, 2016

(54) ADJUSTABLE BRACELET CLASP

(71) Applicant: Omega SA, Bienne (CH)

(72) Inventors: Cedric Kaltenrieder, Bienne (CH); Rocco Catanese, Bienne (CH)

(73) Assignee: OMEGA SA, Bienne (CH)

( * ) Notice: Subject to any disclaimer, the term of this patent is extended or adjusted under 35 U.S.C. 154(b) by 240 days.

(21) Appl. No.: 14/090,369

(22) Filed: Nov. 26, 2013

(65) Prior Publication Data

US 2014/0150223 A1 Jun. 5, 2014

(30) Foreign Application Priority Data

Dec. 4, 2012 (EP) ..... 12195550

(51) Int. Cl.
*A44C 5/24* (2006.01)

(52) U.S. Cl.
CPC ..... *A44C 5/246* (2013.01); *Y10T 24/2155* (2015.01); *Y10T 24/4782* (2015.01)

(58) Field of Classification Search
CPC . Y10T 24/4782; Y10T 24/2155; A44C 5/246
See application file for complete search history.

(56) References Cited

U.S. PATENT DOCUMENTS

| | | | | | |
|---|---|---|---|---|---|
| 1,564,606 | A | * | 12/1925 | Mealy | 24/71 J |
| 2,110,772 | A | * | 3/1938 | Myrberg et al. | 24/71 R |
| 2,532,840 | A | * | 12/1950 | Gaun | 24/71 R |
| 3,863,299 | A | * | 2/1975 | Hocq | 24/71 J |
| 5,749,128 | A | * | 5/1998 | Cuche | 24/71 J |
| 6,308,382 | B1 | * | 10/2001 | Takahashi et al. | 24/265 WS |

FOREIGN PATENT DOCUMENTS

| | | | |
|---|---|---|---|
| CH | 691 159 | A5 | 5/2001 |
| EP | 0 350 785 | A1 | 1/1990 |
| EP | 0 913 106 | A1 | 5/1999 |
| EP | 1 378 185 | A1 | 1/2004 |
| FR | 2 716 778 | A1 | 9/1995 |
| WO | 2010/108728 | A1 | 9/2010 |

* cited by examiner

*Primary Examiner* — Robert J Sandy
(74) *Attorney, Agent, or Firm* — Sughrue Mion, PLLC

(57) ABSTRACT

A bracelet clasp having an unfolding buckle, including first and second strips hinged to each other via a first of the respective ends thereof, between a closed position for wear, and at least one open position, the first strip carrying a fastening for a first bracelet strand, the second, bottom strip carrying a loop at the second end thereof defining a recess for a second bracelet strand and carrying a lug to be inserted in a suitable hole in the bracelet strand to define a point of anchorage of the bracelet to the clasp. The loop has a plurality of sites, substantially aligned along the longitudinal direction of the bracelet, each of which is configured to cooperate with the lug to ensure the assembly thereof to the loop and to define a predefined position of the point of anchorage associated with a predefined usable length of the bracelet.

8 Claims, 3 Drawing Sheets

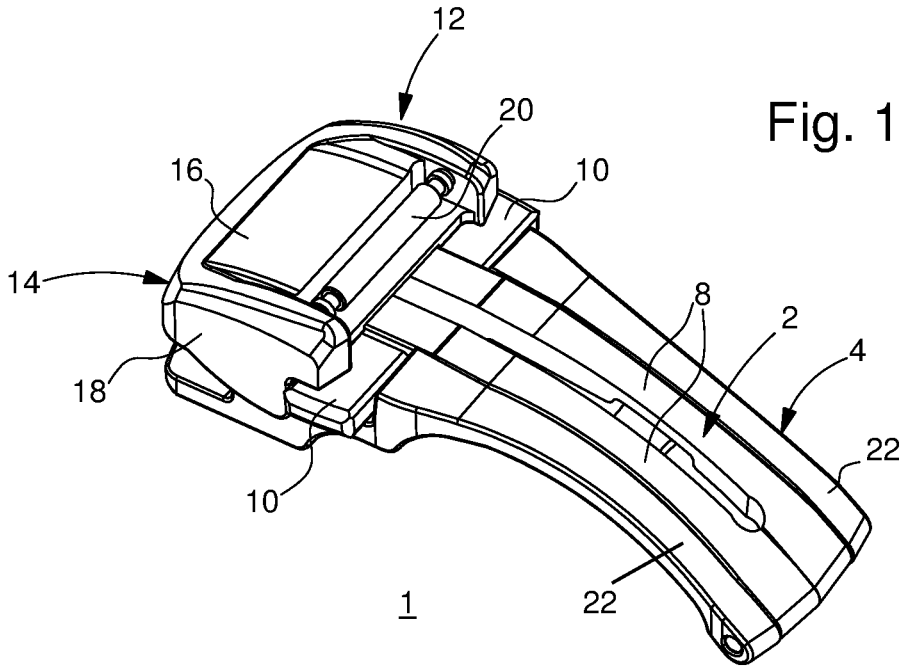
Fig. 1
Fig. 2
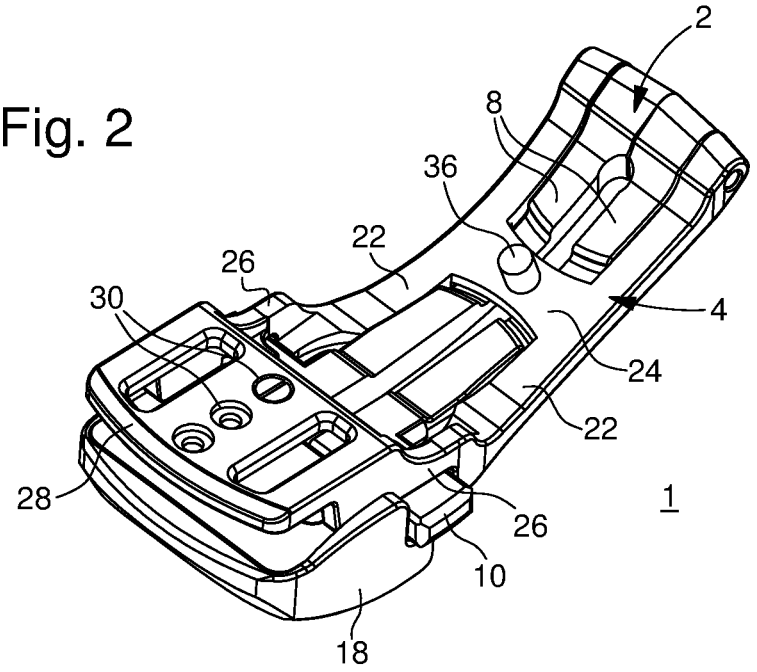

ADJUSTABLE BRACELET CLASP

This application claims priority from European Patent application No. 12195550.4 filed Dec. 4, 2012, the entire disclosures of which is incorporated herein by reference.

FIELD OF THE INVENTION

The present invention concerns a bracelet clasp of the type having an unfolding buckle, including first and second strips hinged to each other, by a first of their respective ends, between a closed position for wear, and at least one open position, the first strip carrying a fastening member to a first bracelet strand, the second, bottom strip comprising a loop at the second end thereof defining a passage for a second bracelet strand and carrying a lug intended to be inserted into a suitable hole in the bracelet strand to define a point of anchorage thereof to the clasp, the clasp further including at least one locking member for holding the first and second strips in the closed position thereof.

The present invention also concerns a wristwatch provided with a clasp of this type,

BACKGROUND OF THE INVENTION

There are well known issues as regards the necessity of providing a device for adjusting the usable length of a bracelet.

On the one hand, in the case of bracelets formed of links, the wrist circumference of the user may have a value that falls between two configurations of the bracelet which differ from each other by a single link. Therefore, it is useful to provide a device for adjusting the usable length of the bracelet that allows a finer adjustment of the bracelet length than the removal or addition of a link.

On the other hand, it is also known that wrist circumference value varies with the season, with the maximum value generally being attained in summer and the minimum value being attained in winter. Here too, it is preferable to provide a fine adjustment device for the usable length of the bracelet that enables the person wearing the bracelet to adjust the length to improve the wear comfort thereof.

By way of example, EP Patent Application No 09131060 A1 discloses a clasp with an unfolding buckle comprising a cover with a series of pairs of holes for housing the ends of a bar for attaching a bracelet. Two adjacent pairs of holes are separated by a distance defining one adjustment pitch of the usable bracelet length, to answer the aforementioned problems.

However, this type of device for adjusting bracelet length is unattractive given that the adjusting holes are visible on the sides of the cover. Further, the adjustment of this type of clasp requires some dexterity since a pointed tool has to be inserted in the holes to compress the bar securing the bracelet, which is likely to lead to damage to the cover if the person performing the adjustment is clumsy.

To avoid this situation, alternative devices have already been disclosed, such as for example in EP Patent No 0350785 B1 which discloses a similar clasp to the above but comprising, by way of alternative, a device for adjusting the usable length of the bracelet that can be operated without using a tool. Indeed, the clasp disclosed in that Patent is of the type with an unfolding buckle comprising two strips hinged to each other by means of a pin that passes through both, each of the strips carrying at the end thereof a fastening member to a bracelet. A first strip carries a hook intended to be engaged in a hole arranged in the second strip to cooperate therein with a spring catch for locking the hook, and therefore the clasp, in a closed state. The second strip includes two portions capable of sliding in relation to each other within a predefined range, defining an adjustment pitch of the usable length of the bracelet. The first of these two portions carries the hinge connecting it to the first strip while the second portion carries the locking spring catch. The hole in which the hook engages to lock the clasp has a length, along the longitudinal direction of the bracelet, which equates to the sliding range of the two portions of the second strip. The spring catch has a central portion defining two sites for the hook, along the longitudinal direction of the bracelet, providing two different usable lengths of the bracelet. A control member including, in particular, a pusher, can actuate the spring catch to release the hook and open the clasp.

It should be noted that one drawback which results from this structure is the loss of bracelet length adjustment each time that the clasp is opened. Consequently, each time the clasp is closed, the wearer of the bracelet has to check that the hook is inserted on the side of the central spring catch portion matching the desired bracelet length.

Adjustment devices comprising a specific locking member have also been proposed, by way of alternative, to avoid this type of drawback.

EP Patent Application No 1378185 A1 provides one such example.

However, these devices generally have complex, conspicuous designs since they can comprise at least one control member used for locking the clasp, at least one additional control member for locking the adjustment device and generally at least one elastic return member.

SUMMARY OF THE INVENTION

It is a main object of the present invention to overcome the drawbacks of known prior art clasps, by proposing a bracelet clasp including a device for adjusting the usable length of a bracelet which has a simple structure, preferably proposes stable adjustment, including when the clasp is open, and which is easy to operate.

The present invention therefore concerns more specifically a bracelet clasp of the aforementioned type, characterized in that the loop has a plurality of sites, substantially aligned along the longitudinal direction of the bracelet, each of which is capable of cooperating with the lug to ensure the assembly thereof to the loop and to define a predefined position of the point of anchorage associated with a predefined usable length of the bracelet.

As a result of these features, the adjustment device of the invention has a very simple design combined with a discreet structure, since it is concealed underneath the bracelet when the latter is worn.

Generally speaking, each of the sites can advantageously be defined by a hole, which is arranged in the loop and in which the lug may partially engage.

Thus it is possible to provide for the lug to be screwed into one or other of the sites or, alternatively, for each of the sites to be defined by a hole passing right through the loop, the lug having the shape of a screw foot arranged to cooperate with a screw through any one of the locations.

These methods of assembling the lug to the loop make it easy to adjust the bracelet length, simply by unscrewing the lug before screwing it into a different site.

Further, with the above features, the present invention answers an additional technical problem, in a preferred variant embodiment.

Indeed, clasps with unfolding buckles are known wherein the second strip carries two lugs, the second lug holding the corresponding bracelet strand against the strip, at a distance from the first lug, and thus improving the general hold of the bracelet strand to the clasp.

FR Patent Application No 2716778 A1 discloses a clasp of this type which, however, has a drawback owing to the fact that the space between the two lugs is defined by design. However, commercially available bracelets do not all have the same pitch between the holes therein. Thus, when the user wishes to change bracelet, he has to be sure to use a new bracelet having an integer number of hole pitches which fits the distance between the two lugs, otherwise it will not be possible to assemble the bracelet to the clasp.

The clasp according to the invention, as described above, could comprise an additional lug aligned with the lug carried by the loop substantially in the longitudinal direction of the bracelet.

Therefore, the possibility of changing the position of the first lug means that the gap between the first lug and the additional lug can be changed, allowing it to fit a bracelet with a different pitch. The clasp thus advantageously allows a larger number of commercially available bracelets to be used than the aforecited prior art clasp.

Further, generally speaking, the first strip could be arranged to carry an additional device for adjusting the usable length of the bracelet, arranged to adjust the position of the fastening in relation to the loop.

In that case, the adjustment device may include a frame, carrying the fastening member and capable of being moved between several positions in the longitudinal direction of the bracelet.

BRIEF DESCRIPTION OF THE DRAWINGS

Other features and advantages of the present invention will appear more clearly upon reading the following detailed description of a preferred embodiment, made with reference to the annexed drawings, given by way of non-limiting example and in which:

FIG. 1 shows a general, simplified, perspective view of a bracelet clasp according to a preferred embodiment of the present invention, where the clasp is closed and illustrated from a first side.

FIG. 2 is a perspective view of the clasp of FIG. 1, illustrated from a second side.

EMBODIMENT(S) OF THE INVENTION

The clasp illustrated in a non-limiting manner in the Figures is a preferred embodiment of the invention. More specifically, clasp 1 is of the type having an unfolding buckle and is intended to close a timepiece bracelet or wristband.

Figure 3:
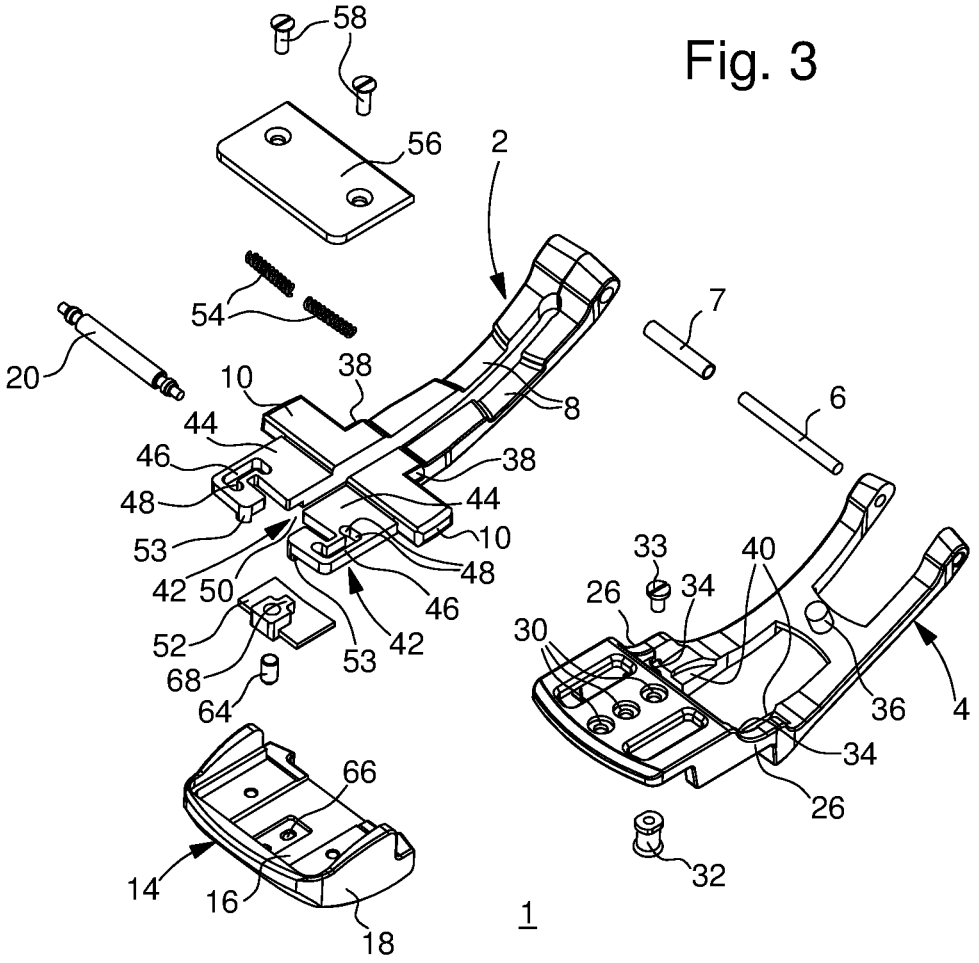
FIG. 3 is an exploded perspective view of the clasp of FIG. 1.

As seen more particularly in FIGS. 1 to 3, clasp 1 includes a first strip 2 hinged on a second strip 4 by means of a pin 6 associated with a sleeve 7, by way of non-limiting illustration. Each of the strips has an elongated shape in the longitudinal direction of the bracelet and is slightly curved to fit the shape of the wearer's wrist.

First strip 2 includes two posts 8 arranged in contact with each other at the respective ends thereof located on the side of pin 6, and each having a cut out portion so that said posts are not in contact with each other over most of the length thereof.

Each of posts 8 carries an extension 10, in proximity to the end thereof furthest from pin 6, extending in a perpendicular direction to the longitudinal direction of the bracelet, to form a pusher, defining a control member for unlocking the clasp, as seen in FIG. 3.

Further, the free end of the first strip 2 carries a device 12 for adjusting the usable length of the bracelet intended to be associated with clasp 1.

Adjustment device 2 includes a cover 14 having a top wall 16 carrying lateral walls 18. The lateral walls 18 are provided with two holes for housing one end of a bar 20 securing a bracelet strand, in a conventional manner.

The second strip 4 includes two arms 22 connected by a transverse post 24 in the central area thereof. Arms 22 are extended by bent portions 26 carrying a loop 28 of a bracelet strand, shifted relative to the general direction of arms 22 to define a recess for the bracelet strand.

Loop 28 has a plurality of holes 30, regularly spaced apart from each other and allowing insertion of a lug 32, intended to be engaged in a hole in the bracelet, to define a point of anchorage of said bracelet to clasp 1. Thus, holes 30 define potential sites for arranging lug 32 on the loop 28, to change the position of the point of anchorage of the bracelet on the clasp and thus the bracelet length when worn, when the clasp has a single lug for securing the bracelet.

Lug 32 takes the form here of a screw foot and is associated with a screw 33, arranged through a hole 30 in order to assemble the lug to loop 28. Advantageously, the lug is partially engaged in hole 30 via a non-circular portion of the periphery which makes the lug easier to screw in and unscrew.

Naturally, other similar structures can be envisaged for assembling the lug to the loop, without departing from the scope of the invention. By way of example, each hole could be tapped, while the lug could include a suitable threading allowing it to be screwed directly into a hole.

Each bent portion 26 has a small tongue 34 for improving the hold of the bracelet strand once it is positioned on clasp 1. The transverse post 24 carries an additional, optional lug 36, intended to be engaged in another hole in the bracelet to further improve the hold thereof on the clasp.

Lug 32 may be placed in one hole 30 or another to define a space, between said lug and additional lug 36, which fits an integer number of hole pitches arranged in the bracelet strand.

Indeed, commercially available bracelets do not necessarily all have the same pitch between the holes therein. Thus, when the user wishes to change the bracelet, if the pitch of the new bracelet is different from that of the old bracelet, the user can change the position of lug 32 on loop 28 to fit the space between lugs 32 and 36 to a multiple of the pitch of the new bracelet, so that each lug can be engaged in one of the bracelet holes.

It will be noted that this easy operation simply requires the use of a screwdriver to unscrew and then screw in lug 32.

The space between arms 22 of second strip 4 defines a recess for housing first strip 2 in the closed state of clasp 1, in a known manner.

Conventional locking means are provided to hold the clasp in the closed state. The external edges of posts 8 comprise portions of increased thickness 38 in proximity to pushers 10, for cooperating with the inner edges of second strip 4, at the recess, via friction. In particular, each inner edge of the second strip has a hollow 40, in which the corresponding portion of increased thickness of first strip 2 is engaged when the clasp is closed. The cut out made in each of posts 8 frees a space which allows the posts to deform elastically when the clasp is locked or when pushers 10 are actuated to release portions of increased thickness 38 of hollows 40 in order to open the clasp.

EP Patent Application No 09131060 A1 discloses in detail a clasp of this type and those skilled in the art may refer thereto if required.

Each pusher 10 is extended by a bolt 42 of the device for adjusting the usable length of the bracelet.

Each bolt 42 includes a plate 44 having a slot 46 oriented in the longitudinal direction of the bracelet and having two notches 48 at the ends thereof.

The bolts are conformed to define between them a recess 50 for housing an intermediate member 52. Bumps 53 are arranged on bolts 42 to hold the intermediate member.

The first function of intermediate member 52 is to present bearing surfaces for a first end of springs 54, the second end of which is abutting against the corresponding plate 44, these springs being arranged to hold bolts 42 in the closed state.

The second function of the intermediate member is to play the part of a spacer for improving the structural stability of the adjustment device.

Indeed, it is clear from FIG. 3 that the frame of the adjustment device includes a bottom wall 56 secured to the top wall 16 of cover 14 by means of two screws 58. Also, the top wall 16 and intermediate member 52 have respective bearing surfaces against which bottom wall 56 is arranged, thereby improving the stability of the corresponding assembly.

Screws 58 are arranged through slots 46. Bolts 42 are thus arranged between the bottom wall 56 and top wall 16, trapped therein by the cooperation of slots 46 with screws 58.

Further, intermediate member 52 carries a ball key 64 for indexing the various possible adjustment configurations.

The operation of adjustment device 12 will now be explained with reference to FIG. 5.

Figure 4:
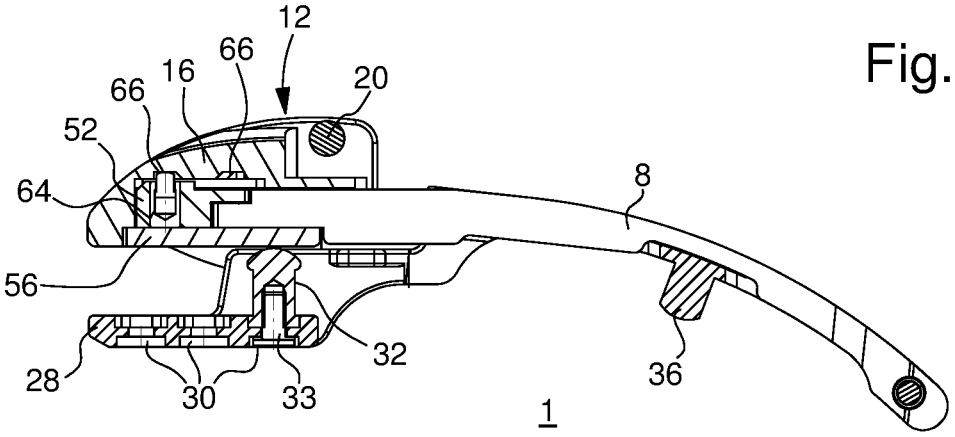
FIG. 4 is longitudinal cross-section of the clasp of FIG. 1.

FIG. 4 shows a longitudinal cross-section of clasp 1.

The assembly of lug 32 to loop 28 is shown clearly in FIG. 4 in addition to the various positions that lug 32 can occupy relative to the different sites 30, in the longitudinal direction of the bracelet, to define different points of anchorage of the corresponding bracelet strand on clasp 1.

In the illustrated embodiment, clasp 1 includes an additional lug 36 for cooperating with another hole in the same bracelet strand as that associated with lug 32; said lug 32 can be moved between the three possible positions, defined by the three sites 30 of loop 28, to change the value of the space between the two lugs 32 and 36, according to the hole pitch of the bracelet to be associated with the clasp.

Adjustment device 12 allows the usable length of the bracelet to be adjusted.

FIG. 4 also better illustrates how ball key 64 cooperates with the top wall 16 of cover 14 to index the various possible adjustment positions of clasp 1. Hollows 66 are arranged in top wall 16 to cooperate with ball key 64 and index the various positions.

Clasp 1 is shown in its long configuration in FIG. 4. If cover 14 is moved towards the left of the Figure, the bracelet (not shown) is shortened.

Figure 5:
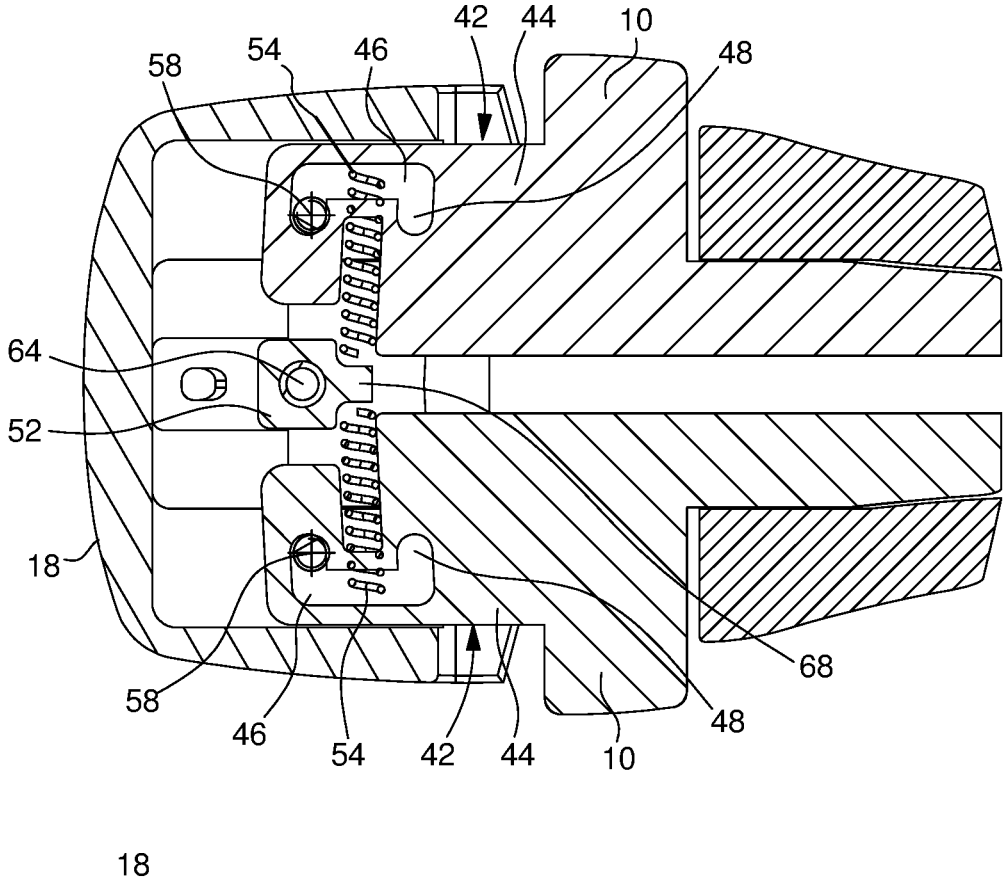
FIG. 5 is cross-section of a design detail of the clasp of FIG. 1.

FIG. 5 shows a cross-section of adjustment device 12 in a neutral plane and facilitates comprehension of how the device operates.

Intermediate member 52 has a small tongue 68 defining two bearing surfaces for the first ends of springs 54 acting on bolts 42 to hold said bolts in the closed state.

When pushers 10 are released, the rest shape of posts 8, assisted by the action of springs 54, holds each bolt 42 in a remote position, corresponding to the closed state.

In this configuration, each of screws 58 is located in one of notches 48 and the frame cannot move in the longitudinal direction of the bracelet with respect to bolts 42.

When pushers 10 are actuated, bolts 42 move towards each other to change into the open state.

Notches 48 shift during this operation, and screws 58 are consequently located in the axis of slots 46 and are thus capable of sliding along the slots to position themselves opposite one notch 48 or another, as required. Thus, when a user actuates pushers 10 to place bolts 42 in the open state, he can then operate cover 14 and move it along the longitudinal direction of the bracelet to change the usable length thereof. When screws 58 are again opposite one of notches 48, posts 8 return to the rest shape, if there is no action by the user on pushers 10, via elasticity and the simultaneous action of springs 54. This action entails the return of bolts 42 to the closed state and thus locks the adjustment member, which includes cover 16, associated with bottom wall 56 and screws 58.

It is clear from this description that the clasp of the present invention includes a lug that is capable of being moved, either to adjust the usable length of the bracelet where the clasp has only one lug, or to adjust the distance between the two lugs where there are two. The design and operation of this lug are simple and enable the user to easily adjust the clasp when necessary.

The preceding description attempts to describe a particular embodiment by way of non-limiting illustration and the invention is not limited to the implementation of certain particular features that have just been described, such as, for example, the shapes that were specifically illustrated and described, or the cooperation thereof for locking the clasp.

Those skilled in the art will not encounter any particular difficulty in adapting the content of the present disclosure to their individual requirements and in implementing a clasp, in particular for a timepiece, without departing from the scope of the invention. It will be noted for example that those skilled in the art will not have any particular difficulty in adapting the teaching herein to the design of an unfolding buckle having a different structure from that illustrated and described here.

Further, the clasp according to the present invention is not limited to the use of three sites 30 for the lug, or even to two positions for adjusting the usable length of the bracelet by means of adjustment device 12. Indeed, those skilled in the art will not encounter any particular difficulty either in adapting the teaching herein to the implementation of a clasp having a higher number of possible adjustment positions.

Likewise, several possible sites may be provided for assembling the second lug 36 to transverse post 24, substantially aligned in the longitudinal direction of the bracelet, which then provides a device for adjusting the usable length of the bracelet, by the movement of two lugs, while maintaining the possibility of adjusting the space between said lugs according to the pitch of the bracelet to be assembled to the clasp, without departing from the scope of the invention.

What is claimed is:

1. A bracelet clasp including an unfolding buckle, comprising:

a first upper strip and a second bottom strip hinged to each other via a first of the respective ends thereof, between a closed position for wear, and at least one open position, said second bottom strip having a face configured to come into contact with a wearer's wrist, said first upper strip carrying a fastening member to a first bracelet strand, said second bottom strip carrying a loop at the second end thereof defining a passage for a second bracelet strand and carrying a lug extending along a direction substantially perpendicular to said face configured to be inserted in a suitable hole in the bracelet strand to define a point of anchorage of said second bracelet strand to said second bottom strip of said clasp; and at least one locking member for holding said first upper strip and second bottom strip in the closed position thereof, wherein said loop has a plurality of sites, substantially aligned along the longitudinal direction of the bracelet, each of which is configured to cooperate with said lug to ensure the assembly thereof to said loop and to define a predefined position of the point of anchorage associated with a predefined usable length of the bracelet.

2. The clasp according to claim 1, wherein each of said sites is defined by a hole arranged in said loop and in which said lug is configured to be partially engaged.

3. The clasp according to claim 2, wherein said lug is configured to be screwed into one or other of said sites.

4. The clasp according to claim 2, wherein each of said sites is defined by a hole passing through said loop, said lug taking the form of a screw foot cooperating with a screw through any of said sites.

5. The clasp according to claim 1, wherein said second bottom strip includes an additional lug aligned with said lug carried by said loop substantially in the longitudinal direction of the bracelet.

6. The clasp according to claim 1, wherein said first upper strip carries an additional device for adjusting the usable length of the bracelet, arranged to adjust the position of said fastening member in relation to said lug carried by said loop.

7. The clasp according to claim 6, wherein said adjustment device includes a frame carrying said fastening and configured to be moved between several positions in the longitudinal direction of the bracelet.

8. A wristwatch including a bracelet provided with a clasp of the type having an unfolding buckle, comprising:

a first upper strip and a second bottom strip hinged to each other via a first of the respective ends thereof, between a closed position for wear, and at least one open position, said second bottom strip having a face configured to come into contact with a wearer's wrist, said first upper strip carrying a fastening member to a first bracelet strand, said second bottom strip carrying a loop at the second end thereof defining a passage for a second bracelet strand and carrying a lug extending along a direction substantially perpendicular to said face configured to be inserted in a suitable hole in the bracelet strand to define a point of anchorage of said second bracelet strand to said second bottom strip of said clasp; and at least one locking member for holding said first upper strip and second bottom strip in the closed position thereof, wherein said loop has a plurality of sites, substantially aligned along the longitudinal direction of the bracelet, each of which is configured to cooperate with said lug to ensure the assembly thereof to said loop and to define a predefined position of the point of anchorage associated with a predefined usable length of the bracelet.

* * * * *